US010509346B2

(12) United States Patent
Mori

(10) Patent No.: US 10,509,346 B2
(45) Date of Patent: Dec. 17, 2019

(54) IMAGE FORMING APPARATUS CONTROLLING ACTUAL TEMPERATURE OF FIXING PART BASED ON TARGET TEMPERATURE AND CUMULATIVE DEVIATION OF ACTUAL TEMPERATURE

(71) Applicant: KYOCERA Document Solutions Inc., Osaka (JP)

(72) Inventor: Masato Mori, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/197,527

(22) Filed: Nov. 21, 2018

(65) Prior Publication Data

US 2019/0196371 A1 Jun. 27, 2019

(30) Foreign Application Priority Data

Dec. 22, 2017 (JP) ..... 2017-246834

(51) Int. Cl.
*G03G 15/20* (2006.01)

(52) U.S. Cl.
CPC ..... *G03G 15/2039* (2013.01)

(58) Field of Classification Search
CPC ..... G03G 15/2039; G03G 15/5004
USPC ..... 399/69; 219/216
See application file for complete search history.

(56) References Cited

U.S. PATENT DOCUMENTS 9,989,901 B2 6/2018 Kadowaki
2002/0106211 A1* 8/2002 Suzuki ..... G03G 15/2039 399/69
2005/0201768 A1* 9/2005 Tatematsu ..... G03G 15/205 399/69
2011/0142472 A1* 6/2011 Mitsuoka ..... G03G 15/2039 399/69
2016/0327889 A1* 11/2016 Shiki ..... G03G 15/205
2017/0185016 A1 6/2017 Kadowaki
2018/0150003 A1* 5/2018 Iesaki ..... G03G 15/2039

FOREIGN PATENT DOCUMENTS

JP 02044386 A * 2/1990
JP 09258601 A * 10/1997
JP 11125988 A * 5/1999
JP 2007241155 A * 9/2007
JP 2011253062 A * 12/2011
JP 2017-116829 A 6/2017

* cited by examiner

*Primary Examiner* — Robert B Beatty

(74) *Attorney, Agent, or Firm* — Studebaker & Brackett PC

(57) ABSTRACT

An image forming apparatus includes a fixing device, a controller, and a storage. The fixing device includes a fixing part that fixes a toner image on a sheet, a heating part that heats the fixing part, and a detecting part that detects an actual temperature of the fixing part. The controller controls the actual temperature of the fixing part based on a target temperature of the fixing part and a cumulative deviation of the actual temperature of the fixing part. The storage stores a convergence value of the cumulative deviation. Every time a heating operation to the fixing part by the heating part is executed, the controller updates the convergence value of the cumulative deviation stored in the storage by a convergence value of the cumulative deviation of a latest heating operation.

13 Claims, 6 Drawing Sheets

IMAGE FORMING APPARATUS CONTROLLING ACTUAL TEMPERATURE OF FIXING PART BASED ON TARGET TEMPERATURE AND CUMULATIVE DEVIATION OF ACTUAL TEMPERATURE

INCORPORATION BY REFERENCE

This application is based on and claims the benefit of priority from Japanese Patent application No. 2017-246834 filed on Dec. 22, 2017; the entire contents of which are incorporated herein by reference.

BACKGROUND

The present disclosure relates to an image forming apparatus including a fixing device that fixes a toner image on a sheet.

A conventional image forming apparatus such as a printer or a multifunction peripheral includes a fixing device that fixes a toner image on a sheet. For example, the fixing device includes a fixing part that fixes the toner image on the sheet and a heating part that heats the fixing part. Generally, in the fixing device as stated above, feedback control is executed regarding an actual temperature of the fixing part.

SUMMARY

In accordance with an aspect of the present disclosure, an image forming apparatus includes a fixing device, a controller, and a storage. The fixing device includes a fixing part that fixes a toner image on a sheet, a heating part that heats the fixing part, and a detecting part that detects an actual temperature of the fixing part. The controller controls the actual temperature of the fixing part based on a target temperature of the fixing part and a cumulative deviation of the actual temperature of the fixing part. The storage stores a convergence value of the cumulative deviation. Every time a heating operation to the fixing part by the heating part is executed, the controller updates the convergence value of the cumulative deviation stored in the storage by a convergence value of the cumulative deviation of a latest heating operation.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

In the first place, a configuration of an image forming apparatus 1 will be explained.

The image forming apparatus 1 is, for example, a multifunction peripheral being compositely provided with printing function, copying function, facsimile function and so forth. Arrows L, R, U, and Lo shown in FIG. 1 respectively indicate a left side, a right side, an upper side, and a lower side of the image forming apparatus 1.

Figure 1:
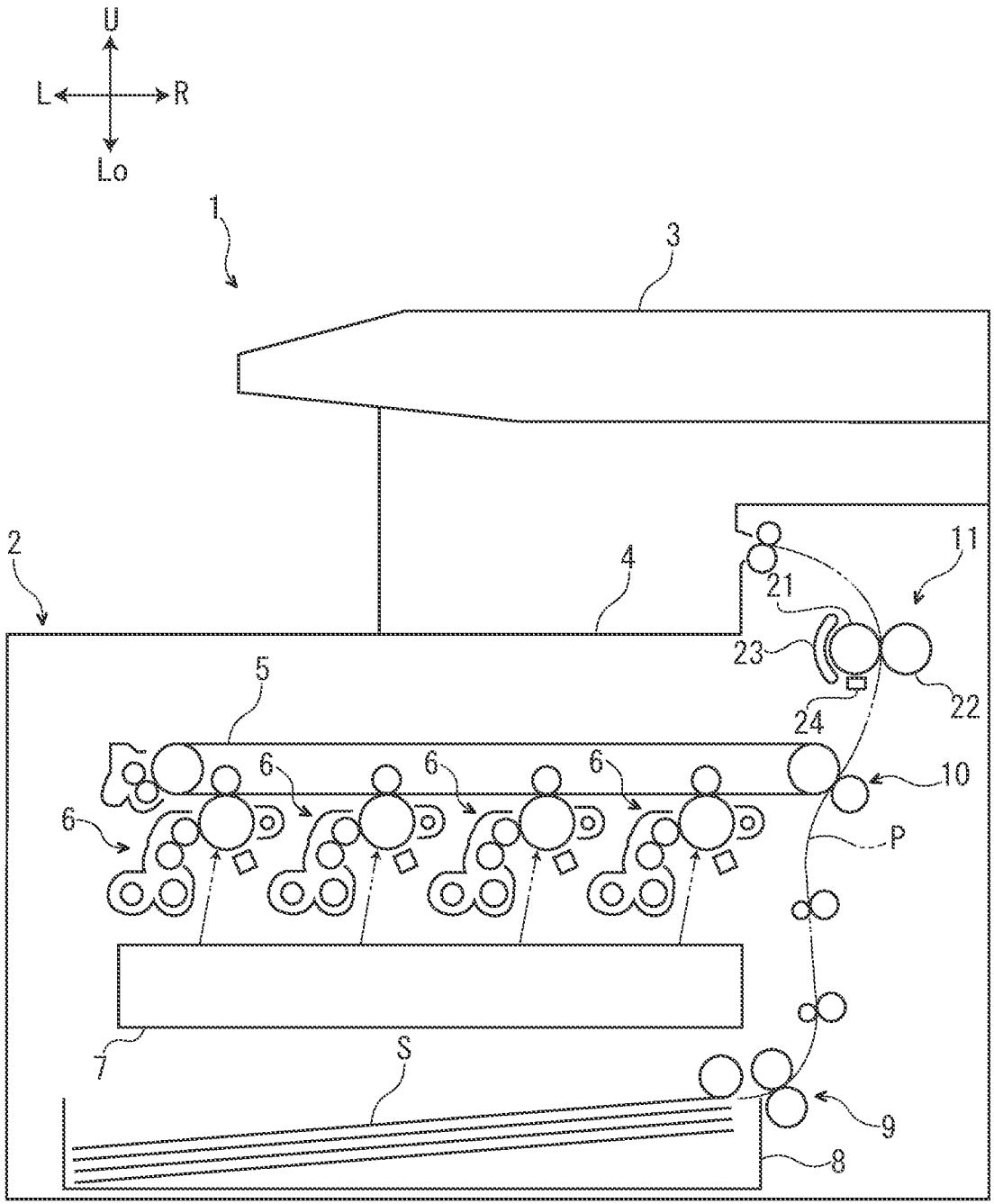
FIG. 1 is a front view that shows an image forming apparatus in accordance with an embodiment of the present disclosure.

With respect to FIG. 1, the image forming apparatus 1 includes a box-shaped main body 2. An image reading device 3 to read an original image is provided in an upper end part of the main body 2. A sheet ejecting tray 4 is provided in an upper side of the main body 2. An intermediate transferring belt 5 and four image forming parts 6 are accommodated in a substantially-central part. The four image forming parts 6 respectively correspond to black toner, cyan toner, magenta toner, and yellow toner. An exposing device 7 is accommodated in a lower part of the main body 2. A sheet feeding cartridge 8 storing sheets S (an example of recording media) is accommodated in a lower end part.

A conveying path P of the sheet S is provided in a right side part of the main body 2. A sheet feeding part 9 is provided at an upstream end part of the conveying path P. A secondary transferring part 10 is provided in a middle part of the conveying path P. A fixing device 11 is provided in a downstream part of the conveying path P. The fixing device 11 is mounted in the main body in an attachable/detachable manner.

The fixing device 11 includes a fixing belt 21 (an example of a fixing part), a pressing roller 22 provided in a right side of the fixing belt 21, an excitation coil 23 (an example of a heating part) provided in a left side of the fixing belt 21, and a thermistor 24 (an example of a detecting part) provided in a lower side of the fixing belt 21. The fixing belt 21 and the pressing roller 22 are in contact with each other. The excitation coil 23 generates a magnetic field around the fixing belt 21 and the fixing belt 21 is heated. That is, the excitation coil 23 heats the fixing belt 21. The thermistor 24 detects an actual temperature of the fixing belt 21.

Next, actions of the image forming apparatus 1 will be explained.

Firstly, electrostatic latent images are respectively formed in the image forming parts 6 by lights from the exposing device 7 (see dashed and double-dotted line arrows in FIG. 1). These electrostatic latent images are respectively developed into toner images in the image forming parts 6. These toner images are primarily transferred on the intermediate transferring belt 5 in the respective image forming parts 6. Accordingly, a full-color toner image is formed on the intermediate transferring belt 5.

While, the sheet S is taken out from the sheet feeding cartridge 8 by the sheet feeding part 9, is conveyed toward a downstream side of the conveying path P, and enters the secondary transferring part 10. In the secondary transferring part 10, the full-color toner image formed on the intermediate transferring belt 5 is secondarily transferred on the sheet S. The sheet S on which the toner image is secondarily transferred is conveyed toward a further downstream side of the conveying path P and enters the fixing device 11. In the fixing device 11, the sheet S and the toner image are heated and pressed by the fixing belt 21 and the pressing roller 22 and then the toner image is fixed on the sheet S. The sheet S on which the toner image is fixed is ejected on the sheet ejecting tray 4.

Subsequently, a controlling system of the image forming apparatus 1 will be explained.

Figure 2:
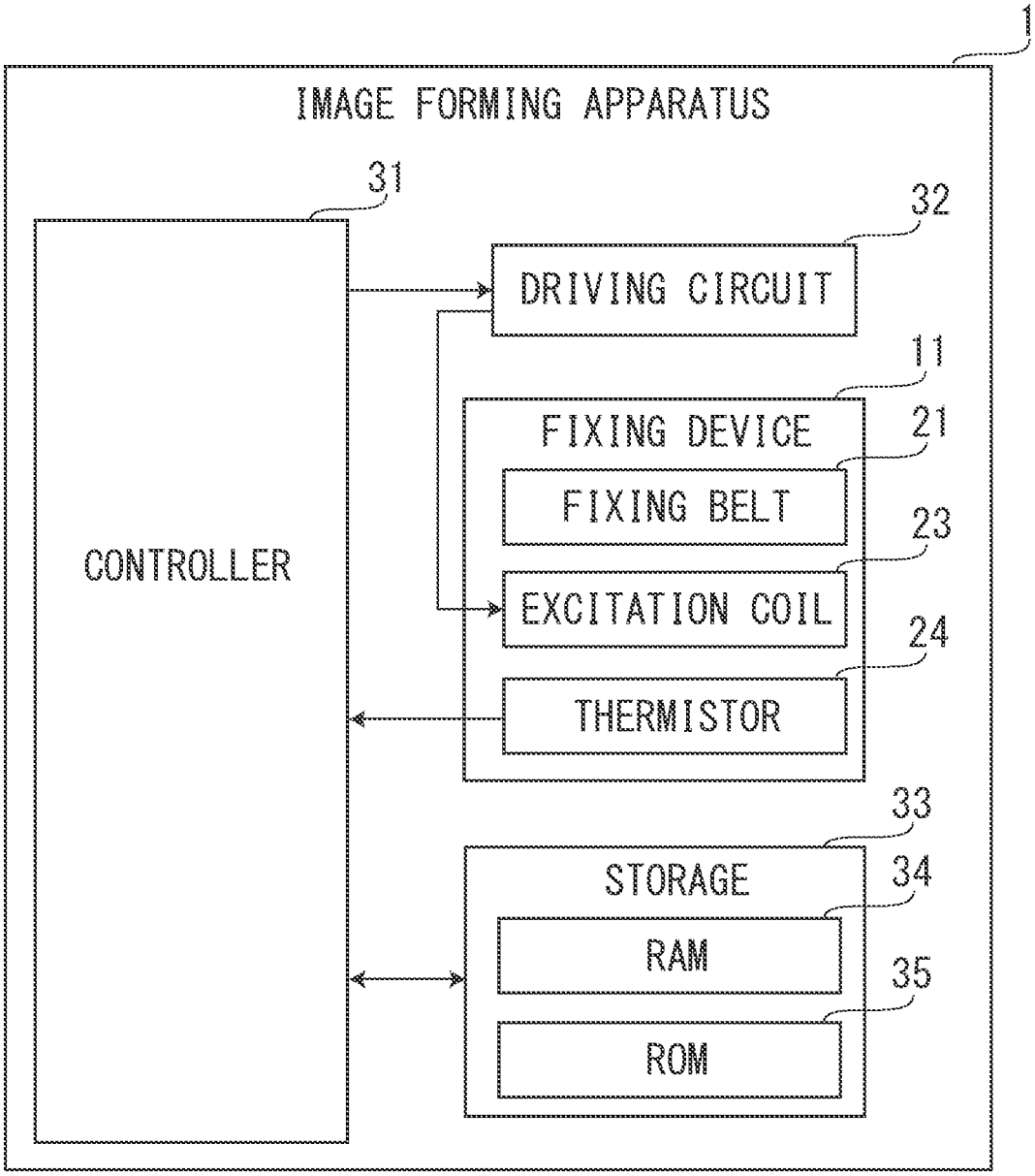
FIG. 2 is a block diagram that shows a controlling system of the image forming apparatus in accordance with the embodiment of the present disclosure.

With reference to FIG. 2, the image forming apparatus 1 includes a controller 31. The controller 31 is, for example, configured by a CPU (a central processing unit). The controller 31 is connected to and controls various parts of the image forming apparatus 1.

The controller 31 is connected to a driving circuit 32. The driving circuit 32 is connected to the excitation coil 23 of the fixing device 11. The driving circuit 32 supplies the excitation coil 23 with a high-frequency electric current based on a signal from the controller 31, and makes the excitation coil 23 heat the fixing belt 21. Hereinafter, "supplied power to the excitation coil 23" means power supplied from the driving circuit 32 to the excitation coil 23.

The controller 31 is connected to the thermistor 24 of the fixing device 11. When the thermistor 24 detects the actual temperature of the fixing belt 21, the thermistor 24 transmits a signal indicating the actual temperature of the fixing belt 21 to the controller 31.

The controller 31 is connected to a storage 33. The storage 33 stores programs and data for controlling. The storage 33 includes a RAM 34 (a Random Access Memory) and a ROM 35 (a Read Only Memory).

In order to steadily fix the toner image on the sheet S in the image forming apparatus 1 configured in the above manner, it is required that the actual temperature of the fixing belt 21 be maintained within a designated temperature range (i.e., a temperature range in which the toner can be melted). To satisfy such requirements, in this embodiment, the controller 31 executes PID control (an example of feedback control) regarding the actual temperature of the fixing belt 21. The PID control will be explained in detail hereinafter.

A following formula (1) is used as a basic formula in the PID control regarding the actual temperature of the fixing belt 21.

$$u(t) = k_p e(t) + K_i \int_0^t e(\tau)d\tau + K_d \frac{de(t)}{dt} \quad (1)$$

u(t): manipulated variable (output of the controller 31)
e(t): temperature deviation
$K_p$: proportional gain
$K_i$: integral gain
$K_d$: derivative gain The temperature deviation e(t) in the formula (1) is calculated by subtracting the actual temperature of the fixing belt 21 from a target temperature of the fixing belt 21. Consequently, the temperature deviation e(t) is a positive value when the target temperature of the fixing belt 21 is higher than the actual temperature of the fixing belt 21, whereas the temperature deviation e(t) is a negative value when the target temperature of the fixing belt 21 is lower than the actual temperature of the fixing belt 21. The target temperature of the fixing belt 21 is stored in the RAM 34 or ROM 35 of the storage 33.

The first term in the right side of the formula (1) is an element to execute proportional control (i.e., P control) regarding the actual temperature of the fixing belt 21, and is referred to as a "proportional element" hereinafter. The proportional element is calculated by multiplying the temperature deviation e(t) by the proportional gain $K_p$.

The second term in the right side of the formula (1) is an element to execute integral control (i.e., I control) regarding the actual temperature of the fixing belt 21, and is referred to as an "integral element" hereinafter. The integral element is calculated by multiplying an integral value of the temperature deviation e(t) by the integral gain $K_i$.

The third term in the right side of the formula (1) is an element to execute derivative control (i.e., D control) regarding the actual temperature of the fixing belt 21, and is referred to as a "derivative element" hereinafter. The derivative element is calculated by multiplying a derivative value of the temperature deviation e(t) by the derivative gain $K_d$.

Figure 3:
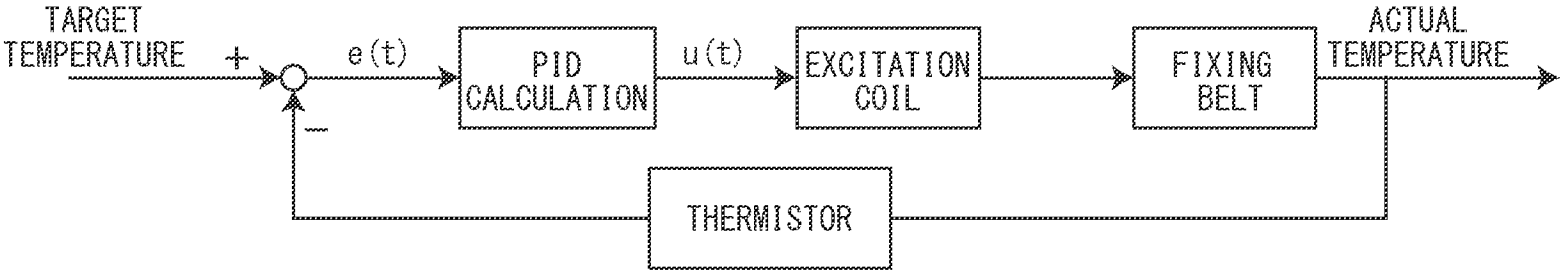
FIG. 3 is a block diagram that shows PID control regarding the image forming apparatus in accordance with the embodiment of the present disclosure.

With reference to FIG. 3, the controller 31 subtracts the actual temperature of the fixing belt 21 from the target temperature of the fixing belt 21 so as to calculate the temperature deviation e(t). Subsequently, the controller 31 executes PID calculation regarding the calculated temperature deviation e(t) according to the formula (1) so as to calculate the manipulated variable u(t).

Subsequently, the controller 31 determines the supplied power to the excitation coil 23 based on the calculated manipulated variable u(t). For instance, when the manipulated variable u(t) is calculated according to the PID calculation to be U1, the controller 31 sets a duty ratio of the supplied power to the excitation coil 23 to be D1, which causes the supplied power to the excitation coil 23 to be P1. On the other hand, when the manipulated variable u(t) is calculated according to the PID calculation to be U2 (<U1), the controller 31 sets the duty ratio of the supplied power to the excitation coil 23 to be D2 (<D1), which causes the supplied power to the excitation coil 23 to be P2 (<P1).

In those way, when the controller 31 increases or decreases the supplied power to the excitation coil 23, the actual temperature of the fixing belt 21 heated by the excitation coil 23 also increases or decreases. The thermistor 24 detects the varying actual temperature of the fixing belt 21, and transmits a signal indicating the detected actual temperature to the controller 31. The controller 31 subtracts the actual temperature of the fixing belt 21 from the target temperature of the fixing belt 21 to calculated the temperature deviation e(t) again. Subsequently, the controller 31 executes the PID calculation regarding the calculated temperature deviation e(t) according to the formula (1) so as to calculate the manipulated variable u(t), and increases or decrease the supplied power to the excitation coil 23 based on the manipulated variable u(t).

As described above, the controller 31 executes the PID control regarding the actual temperature of the fixing belt 21 by increasing or decreasing the supplied power to the excitation coil 23 based on the proportional element being in proportion to the temperature deviation e(t), the integral element including the integral value of the temperature deviation e(t), and the derivative element including the deviation value of the temperature deviation e(t). Hereinafter, the integral value of the temperature deviation e(t) is referred to as a "cumulative deviation C."

In the next place, a problem in a case in which the actual temperature of the fixing belt 21 is controlled based on a designed fixed value will be explained with referring to FIGS. 4 and 5.

Figure 4:
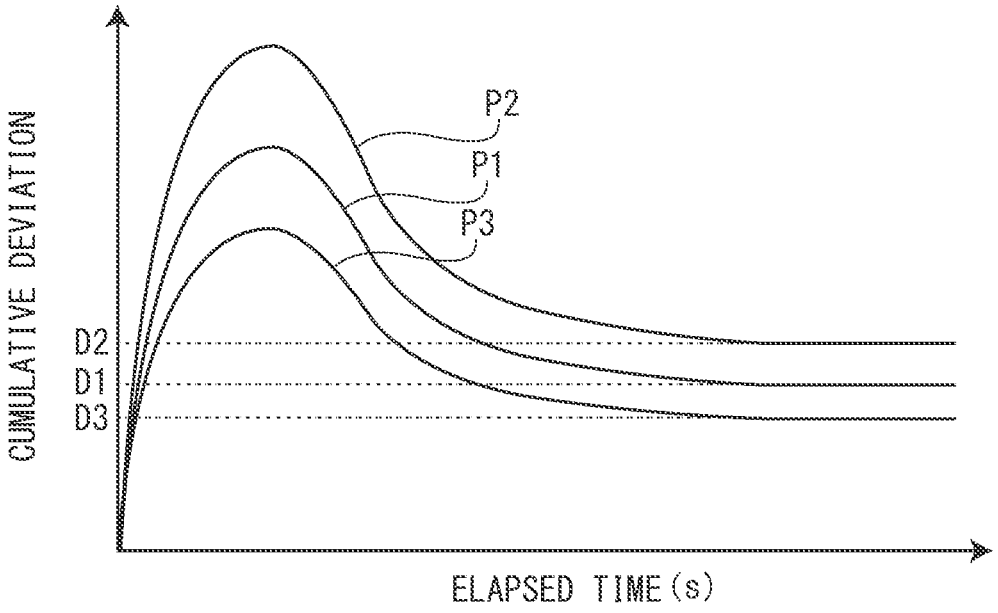
FIG. 4 is a graph that shows relationship between an elapsed time of every fixing device and a cumulative deviation.

A curved line P1 in FIG. 4 indicates a variation of the cumulative deviation C of the fixing device 11 in which the cumulative deviation C corresponds to the designed fixed value. The cumulative deviation C of this fixing device 11 converges to a convergence value D1. A curved line P2 in FIG. 4 indicates a variation of the cumulative deviation C of the fixing device 11 in which the cumulative deviation C is higher than the designed fixed value. The cumulative deviation C of this fixing device 11 converges to a convergence value D2 higher than the convergence value D1. A curved line P3 in FIG. 4 indicates a variation of the cumulative deviation C of the fixing device 11 in which the cumulative deviation C is lower than the designed fixed value. The cumulative deviation C of this fixing device 11 converges to a convergence value D3 lower than the convergence value D1.

As described above, the convergence values of the cumulative deviations C differ depending on the individual fixing devices 11. This is because that temperature characteristics of the fixing devices 11 vary depending on the individuals or change over the years.

Figure 5:
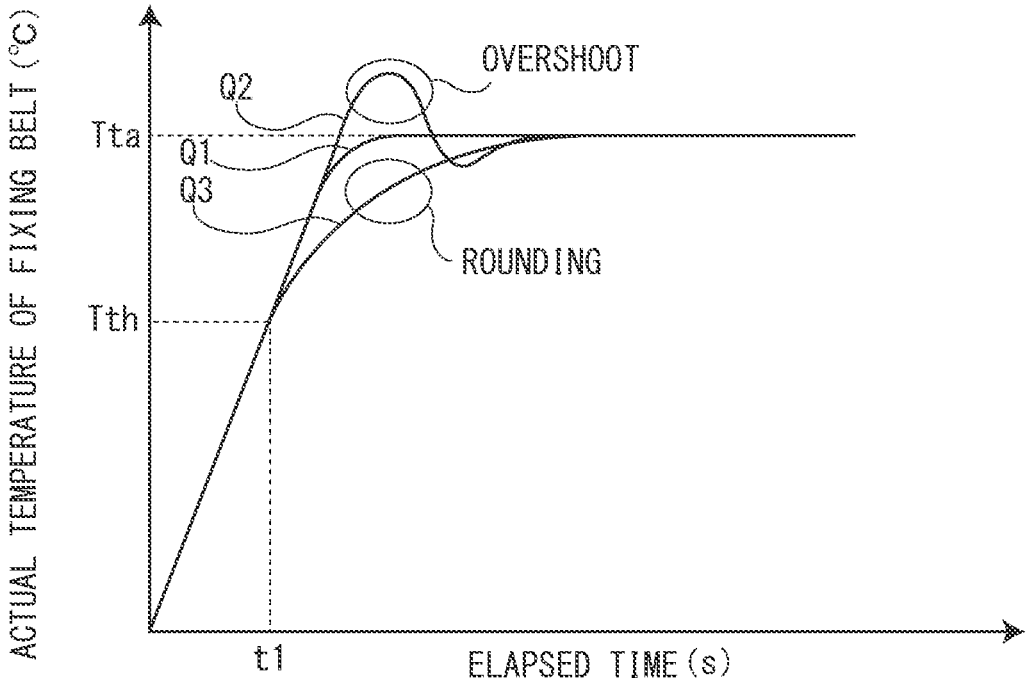
FIG. 5 is a graph that shows relationship between the elapsed time and an actual temperature of a fixing belt when the cumulative deviation is rewritten using a designed fixed value.

In the fixing device 11 in which the cumulative deviation C corresponds to the designed fixed value, a curved line Q1 in FIG. 5 indicates a case in which the cumulative deviation C used in the PID calculation according to the formula (1) is replaced by the designed fixed value at a time t1 when the actual temperature of the fixing belt 21 exceeds a threshold temperature Tth lower than the target temperature Tta. In this case, the actual temperature of the fixing belt 21 can rapidly and steadily converge to the target temperature Tta.

On the other hand, in the fixing device 11 in which the cumulative deviation C does not correspond to the designed fixed value, each of curved lines Q2, Q3 in FIG. 5 indicates a case in which the cumulative deviation C used in the PID calculation according to the formula (1) is replaced by the designed fixed value at the time t1 when the actual temperature of the fixing belt 21 exceeds the threshold temperature Tth. In those cases, overshoot (i.e., overheating) or rounding (i.e., underheating) occurs in the actual temperature of the fixing belt 21. As a result, a time until the actual temperature of the fixing belt 21 converges to the target temperature Tta becomes longer and fluctuations of the actual temperature of the fixing belt 21 become unsteady.

As described above, controlling the actual temperature of the fixing belt 21 based on the designed fixed value cannot cause the actual temperature of the fixing belt 21 to rapidly and steadily converge to the target temperature Tta. Consequently, in this embodiment, this problem will be solved in a following manner. Hereinafter, a "heating operation" indicates a heating operation to the fixing belt 21 by the excitation coil 23.

The storage 33 stores a convergence value of a cumulative deviation C. Every time the heating operation is executed, the controller 31 obtains a convergence value of a cumulative deviation of the latest heating operation (hereinafter, referred to as the "latest convergence value X"), and updates the convergence value of the cumulative deviation C that is stored in the storage 33 by the latest convergence value X that the controller 31 has obtained. Consequently, the latest convergence value X is always stored in the storage 33.

Before the actual temperature of the fixing belt 21 reaches the threshold temperature Tth lower than the target temperature Tta, the controller 31 executes the PID calculation according to the formula (1) to calculate the manipulated variable u(t) in executing the heating operation. The controller 31 rewrites the cumulative deviation C using the latest convergence value X stored in the storage 33 at the time t1 when the actual temperature of the fixing belt 21 exceeds the threshold temperature Tth. For instance, the controller 31 executes PID calculation according to a following formula (2) to calculate the manipulated variable u(t) after the time t1 when the actual temperature of the fixing belt 21 exceeds the threshold temperature Tth.

$$u(t) = K_p e(t) + K_i\left(\int_{t1}^{t} e(\tau)d\tau\right) + X + K_d\frac{de(t)}{dt} \tag{2}$$

Figure 6:
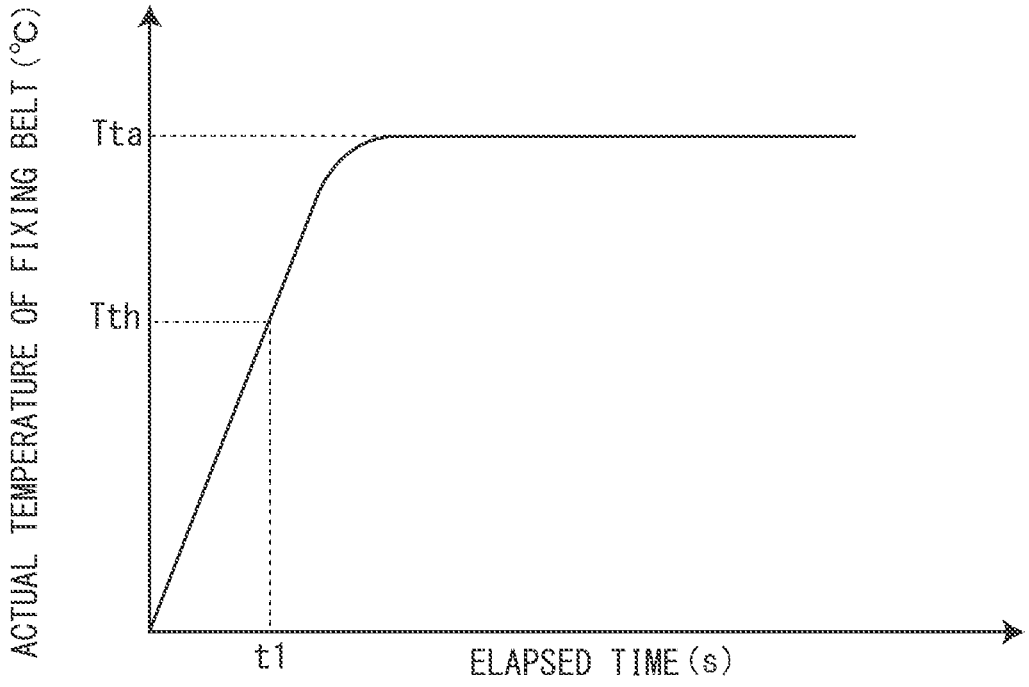
FIG. 6 is a graph that shows relationship between the elapsed time and the actual temperature of the fixing belt when the cumulative deviation is rewritten using a convergence value of the cumulative deviation in a latest heating operation.

In the present embodiment, as described above, every time the heating operation is executed, the controller 31 updates the convergence value of the cumulative deviation C stored in the storage 33 by the latest convergence value X. Adopting such configuration enables to control the actual temperature of the fixing belt 21 using the optimized convergence value of the cumulative deviation C at all times. Accordingly, even when the temperature characteristics of the fixing device 11 varies depending on the individuals or changes over the years, occurrence of the overshoot or the rounding in the actual temperature of the fixing belt 21 can be restrained (see FIG. 6). As a result, the actual temperature of the fixing belt 21 can converge to the target temperature Tta rapidly and steadily.

As described above, the occurrence of the overshoot in the actual temperature of the fixing belt 21 can be restrained, which causes to restrain the fixing belt 21 and surrounding elements from reaching high temperatures. Accordingly, durability of the fixing device 11 can be improved and a product life of the image forming apparatus 1 can be elongated.

As described above, the actual temperature of the fixing belt 21 can rapidly converge to the target temperature Tta, which enables to reduce first print output time of the image forming apparatus 1. Accordingly, usability of the image forming apparatus 1 can be improved.

Only changing the controlling measures of the actual temperature of the fixing belt 21 can cause the actual temperature of the fixing belt 21 to converge to the target temperature Tta rapidly and steadily. Accordingly, increasing production costs based on addition of components or complication of production processes can be restrained.

At the time t1 when the actual temperature of the fixing belt 21 exceeds the threshold temperature Tth lower than the target temperature of the fixing belt 21, the controller 31 rewrites the cumulative deviation C used to control the actual temperature of the fixing belt 21 using the latest convergence value X stored in the storage 33 in executing the heating operation. Adopting such configuration enables to certainly restrain from generating the overshoot or the rounding in the actual temperature of the fixing belt 21.

Incidentally, if the convergence value of the cumulative deviation C stored in the storage 33 remains after the fixing device 11 was replaced by an operator such as a user, a service person or the like, an actual temperature of a fixing belt 21 in a replaced fixing device 11 is controlled based on the convergence value of the cumulative deviation C of the fixing device 11 before replacement. In such a situation, there is a possibility that large overshoot or rounding in the actual temperature of the fixing belt 21 occurs at the first heating operation after replacing the fixing device 11 in a case in which temperature characteristics of the replaced fixing device 11 greatly differ from the temperature characteristics of the fixing device 11 before the replacement.

For this reason, when the fixing device 11 is replaced, the controller 33 resets the convergence value of the cumulative deviation C stored in the storage 33. Whereby the large overshoot or rounding in the actual temperature of the fixing belt 21 can be restrained at the first heating operation after replacing the fixing device 11, which enables to rapidly execute control suitable for the temperature characteristics of the replaced fixing device 11.

Incidentally, the actual temperature of the fixing belt 21 at the beginning of the heating operation is higher when the fixing device 11 returns from a sleep state to a normal printing state (hereinafter, referred to as "when returning from sleep") than when the fixing device 11 returns from a cold machine state to the normal printing state (hereinafter, referred to as "when returning from cold"). Consequently, a period from the beginning of the heating operation until the convergence of the actual temperature of the fixing belt 21 to the target temperature Tta becomes shorter when returning from sleep. As a result, when returning from sleep, the fixing device 11 may finish a printing operation and transit to the sleep state or an OFF state earlier than when returning from cold. For this reason, when returning from sleep, if the controller 31 tries to obtain the latest convergence value X at the same timing when returning from cold, the fixing device 11 may transit to the sleep state or the OFF state before obtaining and the controller 31 may fail to obtain the latest convergence value X.

Accordingly, the controller 31 obtains the latest convergence value X when a fluctuating range of the actual temperature of the fixing belt 21 during a predetermined time period falls within a reference range. Consequently, when returning from sleep, the fluctuating range of the actual temperature of the fixing belt 21 becomes to fall within the reference range earlier than when returning from cold, and thus the controller 31 can obtain the latest convergence value X earlier than when returning from cold. Accordingly, it can be restrained that the controller 31 fails to obtain the latest convergence value X when returning sleep, and thus the controller 31 can obtain the latest convergence value X with a high frequency.

Incidentally, since heat of the fixing belt 21 is deprived by the sheet S during execution of the printing operation, the actual temperature of the fixing belt 21 becomes unstable. Accordingly, the controller 31 obtains the latest convergence value X during the execution of the printing operation, it is difficult for the controller 31 to obtain the latest convergence value X that exactly reflects the temperature characteristics of the fixing device 11.

Consequently, the controller 31 obtains the latest convergence value X at a time (e.g., a time when the actual temperature of the fixing belt 21 becomes stable after passage of a predetermined period after finishing the printing operation) other than during the execution of the printing operation. Adopting such configuration, the controller 31 can obtain the convergence value X that exactly reflects the temperature characteristics of the fixing device 11.

In this embodiment, the fixing belt 21 is used as a fixing part. Alternatively, in another different embodiment, a component (e.g., a fixing roller) other than the fixing belt 21 may be used as the fixing part.

In this embodiment, the excitation coil 23 is used as a heating part. Alternatively, in another different embodiment, a component (e.g., a halogen heater) other than the excitation coil 23 may be used as the heating part.

In this embodiment, the thermistor 24 is used as a detecting part. Alternatively, in another different embodiment, a component (e.g., a thermopile) other than the thermistor 24 may be used as the detecting part.

In this embodiment, the image forming apparatus 1 is a multifunction peripheral. Alternatively, in another different embodiment, the image forming apparatus 1 may be a printer, a copying machine, a facsimile, or the like.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. An image forming apparatus comprising:

a fixing device including a fixing part configured to fix a toner image on a sheet, a heating part configured to heat the fixing part, and a detecting part configured to detect an actual temperature of the fixing part, a controller configured to control the actual temperature of the fixing part based on a target temperature of the fixing part and a cumulative deviation of the actual temperature of the fixing part, and a storage configured to store a convergence value of the cumulative deviation, wherein, every time a heating operation to the fixing part by the heating part is executed, the controller updates the convergence value of the cumulative deviation stored in the storage by a convergence value of the cumulative deviation of a latest heating operation, in executing the heating operation to the fixing part by the heating part, the controller rewrites the cumulative deviation used to control the actual temperature of the fixing part using the convergence value of the cumulative deviation stored in the storage at a time when the actual temperature of the fixing part exceeds a threshold temperature lower than the target temperature of the fixing part.

2. The image forming apparatus according to claim 1, wherein the controller controls the actual temperature of the fixing part based on a proportional element in proportion to a temperature deviation of the target temperature and the actual temperature and a derivative element including a derivative value of the temperature deviation, in addition to the cumulative deviation.

3. The image forming apparatus according to claim 1, wherein the controller resets the convergence value of the cumulative deviation stored in the storage when the fixing device is replaced.

4. The image forming apparatus according to claim 1, wherein the controller obtains the convergence value of the cumulative deviation of the latest heating operation when a fluctuating range of the actual temperature of the fixing part falls within a reference range.

5. The image forming apparatus according to claim 1, wherein the controller obtains the convergence value of the cumulative deviation of the latest heating operation at a time other than during execution of a printing operation.

6. The image forming apparatus according to claim 5, wherein the time is when the actual temperature of the fixing part becomes stable after passage of a predetermined period after finishing the printing operation.

7. An image forming apparatus comprising:

a fixing device including a fixing part configured to fix a toner image on a sheet, a heating part configured to heat the fixing part, and a detecting part configured to detect an actual temperature of the fixing part, a controller configured to control the actual temperature of the fixing part based on a target temperature of the fixing part and a cumulative deviation of the actual temperature of the fixing part, and a storage configured to store a convergence value of the cumulative deviation, wherein, every time a heating operation to the fixing part by the heating part is executed, the controller updates the convergence value of the cumulative deviation stored in the storage by a convergence value of the cumulative deviation of a latest heating operation, the controller resets the convergence value of the cumulative deviation stored in the storage when the fixing device is replaced.

8. The image forming apparatus according to claim 7, wherein the controller controls the actual temperature of the fixing part based on a proportional element in proportion to a temperature deviation of the target temperature and the actual temperature and a derivative element including a derivative value of the temperature deviation, in addition to the cumulative deviation.

9. The image forming apparatus according to claim 7, wherein the controller obtains the convergence value of the cumulative deviation of the latest heating operation when a fluctuating range of the actual temperature of the fixing part falls within a reference range.

10. The image forming apparatus according to claim 7, wherein the controller obtains the convergence value of the cumulative deviation of the latest heating operation at a time other than during execution of a printing operation.

11. The image forming apparatus according to claim 10, wherein the time is when the actual temperature of the fixing part becomes stable after passage of a predetermined period after finishing the printing operation.

12. An image forming apparatus comprising:

a fixing device including a fixing part configured to fix a toner image on a sheet, a heating part configured to heat the fixing part, and a detecting part configured to detect an actual temperature of the fixing part, a controller configured to control the actual temperature of the fixing part based on a target temperature of the fixing part and a cumulative deviation of the actual temperature of the fixing part, and a storage configured to store a convergence value of the cumulative deviation, wherein, every time a heating operation to the fixing part by the heating part is executed, the controller updates the convergence value of the cumulative deviation stored in the storage by a convergence value of the cumulative deviation of a latest heating operation, the controller obtains the convergence value of the cumulative deviation of the latest heating operation when a fluctuating range of the actual temperature of the fixing part falls within a reference range.

13. The image forming apparatus according to claim 12, wherein the controller controls the actual temperature of the fixing part based on a proportional element in proportion to a temperature deviation of the target temperature and the actual temperature and a derivative element including a derivative value of the temperature deviation, in addition to the cumulative deviation.

* * * * *